US009870882B2

(12) United States Patent
Delande et al.

(10) Patent No.: US 9,870,882 B2
(45) Date of Patent: Jan. 16, 2018

(54) PUSH BUTTON FOR MOTOR VEHICLE KEY MODULE

(71) Applicant: VALEO SECURITE HABITACLE, Créteil (FR)

(72) Inventors: Benoît Delande, Creteil (FR); Karim Namar, Creteil (FR)

(73) Assignee: VALEO SECURITE HABITACLE, Creteil (FR)

( * ) Notice: Subject to any disclaimer, the term of this patent is extended or adjusted under 35 U.S.C. 154(b) by 0 days.

(21) Appl. No.: 14/414,205

(22) PCT Filed: Jul. 12, 2013

(86) PCT No.: PCT/EP2013/064824

§ 371 (c)(1),
(2) Date: Jan. 12, 2015

(87) PCT Pub. No.: WO2014/009546

PCT Pub. Date: Jan. 16, 2014

(65) Prior Publication Data

US 2015/0179370 A1 Jun. 25, 2015

(30) Foreign Application Priority Data

Jul. 13, 2012 (FR) ..... 12 02009

(51) Int. Cl.

| | |
|---|---|
| ***H01H 13/705*** | (2006.01) |
| ***G05G 1/02*** | (2006.01) |
| ***G07C 9/00*** | (2006.01) |

(52) U.S. Cl.

CPC ..... *H01H 13/705* (2013.01); *G05G 1/02* (2013.01); *G07C 9/00944* (2013.01); *H01H 2215/008* (2013.01); *H01H 2231/032* (2013.01)

(58) Field of Classification Search

CPC ..... H01H 13/705; H01H 9/18; H01H 9/00; G05G 1/02

(Continued)

(56) References Cited

U.S. PATENT DOCUMENTS 5,824,978 A * 10/1998 Karasik ..... H01H 13/702 200/18
6,413,598 B1 * 7/2002 Motoki ..... H01H 13/705 200/314

(Continued)

FOREIGN PATENT DOCUMENTS

| | | |
|---|---|---|
| EP | 1 465 118 A2 | 10/2004 |
| FR | 2 778 014 A1 | 10/1999 |
| FR | 2 791 465 A1 | 9/2000 |

OTHER PUBLICATIONS

International Search Report issued in PCT/EP2013/064824 dated Oct. 7, 2013 (4 pages).

*Primary Examiner* — Edwin A. Leon
*Assistant Examiner* — Iman Malakooti
(74) *Attorney, Agent, or Firm* — Osha Liang LLP

(57) ABSTRACT

The invention relates to a button of the push-button type, comprising: a fixed part (3) forming a chassis, a mobile part (5) capable of translational movement between a rest position, adopted in the absence of actuation by a user, and an actuating position, adopted when the mobile part (5) is depressed with respect to the fixed part (3), a switch (7) toggling from a first state to a second when the mobile part (3) is brought into the actuating position, a flexible membrane (9) positioned between the mobile part (5) and the switch (7), connected by its edges to the fixed part (3) and returning the mobile part (5) to the rest position in the absence of actuation by the user, characterized in that: the membrane (9) has a thinning (15) of its thickness facing the (Continued)

switch (7). The invention also relates to the vehicle key module comprising at least one such button (1).

14 Claims, 2 Drawing Sheets

(58) Field of Classification Search
USPC ..... 200/513, 314, 5 A
See application file for complete search history.

(56) References Cited

U.S. PATENT DOCUMENTS

| | | | | |
|---|---|---|---|---|
| 7,897,888 | B2 * | 3/2011 | Dimig | E05B 19/0082 200/302.2 |
| 2002/0027065 | A1 * | 3/2002 | Kenmochi | H01H 13/705 200/314 |
| 2012/0111709 | A1 * | 5/2012 | Senzaki | H01H 9/0235 200/5 A |

* cited by examiner

PUSH BUTTON FOR MOTOR VEHICLE KEY MODULE

BACKGROUND OF THE INVENTION

The present invention relates to a push button, of the type pressed in by a user in order to actuate a commutator, in particular integrated in a motor vehicle key module, comprising a communication member for opening and closing the doors of the vehicle remotely.

Those push buttons are based on the pressing-in of a movable portion which is caused to move by a pressing effort by a user and is pressed in with respect to a fixed portion, generally the member which carries the button.

The buttons, in particular push buttons, have a line of the effort applied in accordance with the generally increasing pressing-in action, up to a threshold value, at which the effort applied abruptly decreases. That decrease in the effort is felt by the user and this is what is perceived as a "click", even if the mechanism does not produce any noise, which provides a haptic return reassuring the user that his instruction has been taken into consideration.

The decrease in the effort felt is referred to as the snap effect of the button, which is measured as being the relationship $\Delta F/F$ between the decrease in the effort and the absolute value of the maximum effort applied just before the decrease, which is therefore non-dimensionalized.

That snap effect results from the mechanism of the commutators used which have a plurality of states of minimum energy, corresponding to different commutating states which are separated two by two by a potential energy barrier which is overcome by the actuation action. From an initial state, the potential energy maximum is reached at the so-called tipping point, beyond which the mechanism pivots into the final state of its own accord.

It is known to use flexible diaphragms as the resilient element which ensures the return of the movable portion of the push button. Those diaphragms perform a double function in that they allow the return to a rest position of the movable portion, and in that they isolate the electronic commutator from the external environment.

For better actuation of the commutator, the portion of the diaphragm often has an excessive thickness at the surface facing the commutator, acting as a finger pressing in the commutator.

Those structures produce a snap effect in the order of from 15 to 20%.

That perception of the haptic return may be considered to be insufficient in that, generally, a clearly defined snap effect is felt as a sign of quality by a user.

SUMMARY OF THE INVENTION

In order to comply at least partially with the need mentioned above, the invention relates to a push type button comprising:

- a fixed portion which forms a frame,
- a movable portion which can be moved in terms of translation between a rest position which is taken up in the absence of any actuation by a user and an actuation position which is taken up by pressing in the movable portion in relation to the fixed portion,
- a commutator which pivots from a first state toward a second state when the movable portion is brought into the actuation position,
- a flexible diaphragm which is arranged between the movable portion and the commutator, which is connected at the edges thereof to the fixed portion and which moves the movable portion into a rest position in the absence of any actuation by the user, characterized in that:
- the diaphragm comprises a narrowing of the thickness thereof opposite the commutator.

The buttons obtained in this manner have improved characteristics in terms of the haptic perception of the snap effect, which makes the buttons more pleasant and potentially more practical and reliable to use.

The button according to the invention may further have one or more of the following features, taken alone or together.

The narrowing comprises a recess at the outer surface of the diaphragm and the movable portion comprises a protuberance which has a complementary shape and which is inserted in the recess.

The narrowing comprises a recess at the inner surface of the diaphragm and the commutator comprises an upper portion which has a complementary shape and which is inserted in the recess when the button is actuated.

The recess may thus in particular have a progressively changing cross-section, for example, it may be conical, trapezoidal or stepped.

The movable portion is adhesively bonded or welded to the outer surface of the diaphragm.

Where applicable, the recess and the protuberance may have slightly different shapes so as to cause an accumulation of adhesive therebetween.

The outer surface of the diaphragm comprises grooves for the adhesive which is intended to keep the movable portion adhesively bonded.

The diaphragm is produced from an injection-molded thermoplastic elastomer material, the injection-molded thermoplastic elastomer material being able to be one of the following: polyurethane elastomer material, polyethylene elastomer material, polyamide elastomer material.

The invention also relates to the vehicle key module having an integrated transmitter for the remote control of locking/unlocking functions for the doors of a vehicle, characterized in that it comprises at least one button as described above.

BRIEF DESCRIPTION OF THE DRAWINGS

Other features and advantages of the invention will be appreciated more clearly from a reading of the following description which is given by way of illustrative and non-limiting example, and the appended drawings, in which.

In all the Figures, the same reference numerals refer to the same elements.

DETAILED DESCRIPTION OF THE INVENTION

Figure 1:
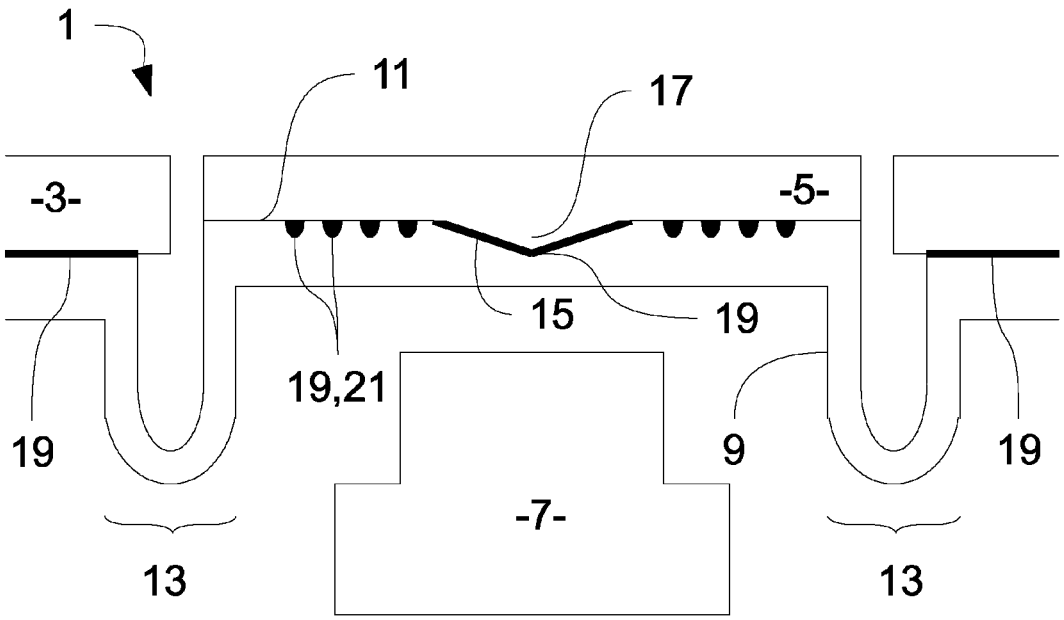
FIG. 1 is a schematic cross-section of a push type button according to a first embodiment of the invention.

FIG. 1 shows schematically a push type button 1 according to an embodiment of the invention.

The button 1 comprises a fixed portion 3 which forms a frame, a movable portion 5 which is intended to be pressed down in order to actuate the button, a commutator 7 which pivots between two states, a first state and a second state, for example, open and closed, when the button 1 is actuated and a diaphragm 9 which is attached to the fixed portion 3 and which carries the movable portion 5 of the button 1.

The fixed portion 3 of the button 1 is, for example, the body of a vehicle key module having an integrated transponder for remotely controlling locking functions of the vehicle, such as locking/unlocking the doors and the luggage compartment lid.

Such a key module generally comprises a plurality of buttons 1, one button for locking the doors, one button for unlocking them and optionally an additional button for locking/unlocking the luggage compartment lid separately.

The movable portion 5 is a metal or plastics plate, preferably of injection-molded plastics material, which has an outer face which generally carries a pictogram which indicates the function of the button. The movable portion 5 is generally integrated in the front face of the key module, and it is the component which the user presses in order to actuate the button 1.

The movable portion 5 is movable in terms of translation between a rest position, taken up in the absence of any pressure or actuation, and an actuation position, corresponding to the position taken up by the movable portion 5 when the user presses it down in order to actuate the button 1.

An electronic commutator 7 is located under the movable portion 5. That commutator 7 is a pivot type commutator. The commutator 7 is crushed when the user presses down the movable portion 5 as far as a tipping point, which is reached when the movable portion 5 is in an actuation position. When the tipping point is reached, the commutator 7 pivots from a first initial commutation state, for example, open or closed if it is a switch, toward a second final commutation state, which is open or closed in the case of the switch, respectively.

Those commutators 7 generally comprise a movable portion which extends into a fixed portion when it is actuated and a resilient return element which brings the movable portion back into a rest position and which stores the potential energy required for the pivoting action (commutators known as "microswitches" or integrated commutators).

The commutator 7 is generally carried by a printed circuit board which also carries electronic elements which are intended to be controlled by the actuation of the switch 7. In the case of a motor vehicle key module, the printed circuit board carries, for example, the transmitter of the locking/unlocking signal for the doors.

A diaphragm 9 is positioned between the movable portion 5 and the commutator 7. That diaphragm 9 is a flexible diaphragm, in particular produced by injection-molding thermoplastic elastomer material, for example, thermoplastic polyurethane elastomer material (TPU), thermoplastic polyethylene elastomer material (TPE) or thermoplastic polyamide elastomer material (TPA).

The diaphragm 9 is attached at the edges thereof to the fixed portion 3, for example, by adhesive bonding. It has an upper surface 11 which carries the movable portion 5 and deformation zones 13, between the portions adhesively bonded to the fixed portion 3 and the upper surface 11.

As a result of its resilience, the diaphragm 9 forms a resilient return element which brings back the movable portion 5 into a rest position when the user releases the pressure on the movable portion 5.

In order to allow easier pressing-in of the movable portion 5 and in order to prevent permanent non-resilient deformation of the diaphragm 9, the diaphragm comprises deformation zones 13 at the periphery thereof, comprising a peripheral portion of the diaphragm 9 having a U-like cross-section.

The deformation of the diaphragm 9 is then carried out by displacing the bend forming the base of the U along a peripheral portion of the diaphragm 9 and/or by curving the faces corresponding to the members of the U.

The diaphragm 9 comprises a narrowing 15 of the thickness thereof, in a position opposite the commutator 7. In the embodiment illustrated in FIG. 1, the narrowing 15 substantially comprises a recess which has a conical form and which is located on the outer surface 11 of the diaphragm 9.

Other embodiments may be envisaged, for example, with a narrowing 15 which has a rounded shape, is trapezoidal or even stepped. Those cross-sectional shapes which vary progressively ensure that, during injection-molding, the material injected fills the entire space of the mold, including the narrowed portion, in spite of the surface tensions and the effects of viscosity.

If the materials allow, the narrowing 15 may of course simply be parallelepipedal.

The movable portion 5 comprises a protuberance 17 which has a corresponding shape and dimensions and which is inserted into the recess which forms the narrowing 15, some adhesive 19 being applied in the recess which forms the narrowing 15 before moving the movable portion 5 into contact for the fixing thereof. A slight difference in shape, for example, the angle of aperture of the cone, may be provided between the recess 15 and the protuberance 17 so as to cause a controlled accumulation of adhesive 19 therebetween, which improves the fixing and rigidity.

In order to allow better adhesive bonding of the movable portion 5, the outer surface of the diaphragm 9 comprises a plurality of grooves 21, in which the adhesive 19 which is intended to retain the movable portion 5 is introduced and then sets.

In the alternative, the movable portion 5 may be welded, for example, by ultrasound or laser, at the outer surface of the diaphragm.

Figure 2:
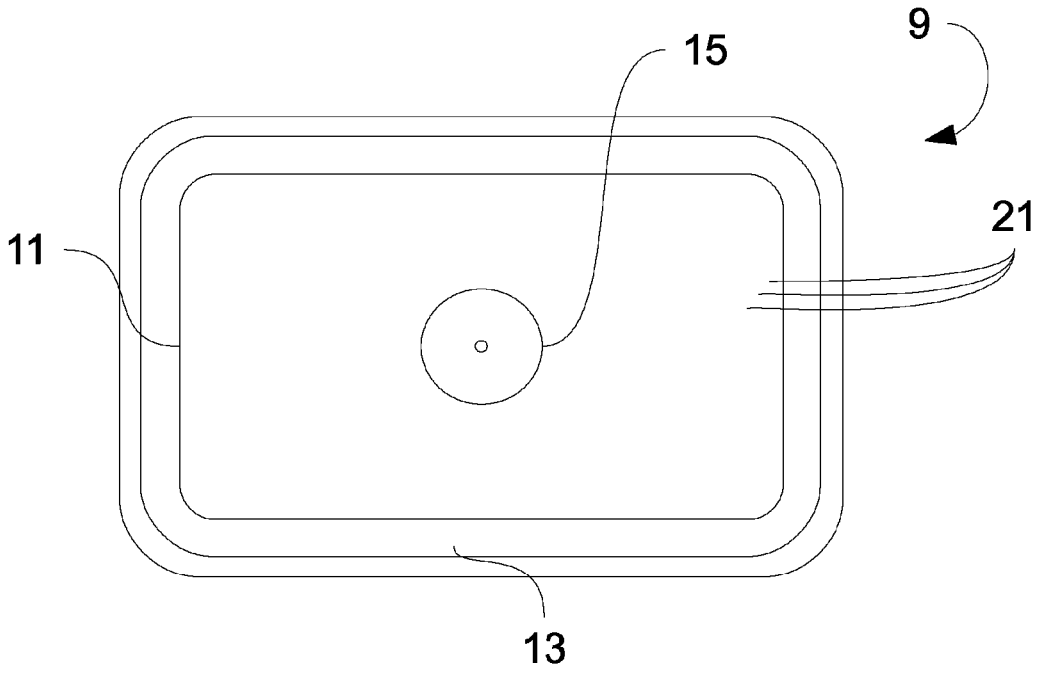
FIG. 2 is a top view of a diaphragm as used in the button of FIG. 1.

FIG. 2 is a top view of the diaphragm 9 as described above. This Figure shows in particular the pattern of the grooves 21, in this instance in the form of parallel lines. Other patterns may also be envisaged, such as diagonal patterns, concentric circles, or even simple, uniformly distributed point-like indentations.

FIG. 2 also shows that the deformation zone 13 extends completely round the diaphragm 9. By thus completely surrounding the diaphragm 9 with a deformation zone 13 and by adhesively bonding it to the fixed portion 3 over the entire periphery, a relative tightness of the space inside the diaphragm 9 and the fixed portion 3 is ensured, which allows protection of the commutator 7 from any harmful external elements which are introduced into the button 1, for example, dust and humidity.

The narrowing 15 allows better transmission of the efforts of the commutator 7 to the movable portion on which the finger of the user who is intended to feel the snap effect is positioned.

In particular, the fact that the diaphragm 9 is flexible causes it to absorb a portion of the efforts in the form of deformations and shearing actions, which are not perceived by the user. Consequently, the narrowing thereof reduces the portion of efforts dissipated.

By practically the entirety of the surface of the diaphragm 9 being covered with grooves 21, a more extensive adhesion of the diaphragm 9 to the movable portion is obtained, which improves the rigidity of the button 1 and therefore the haptic perception by preventing a dispersion of efforts via oscillations of the diaphragm 9 which are not transmitted to the movable portion 5.

Figure 3:
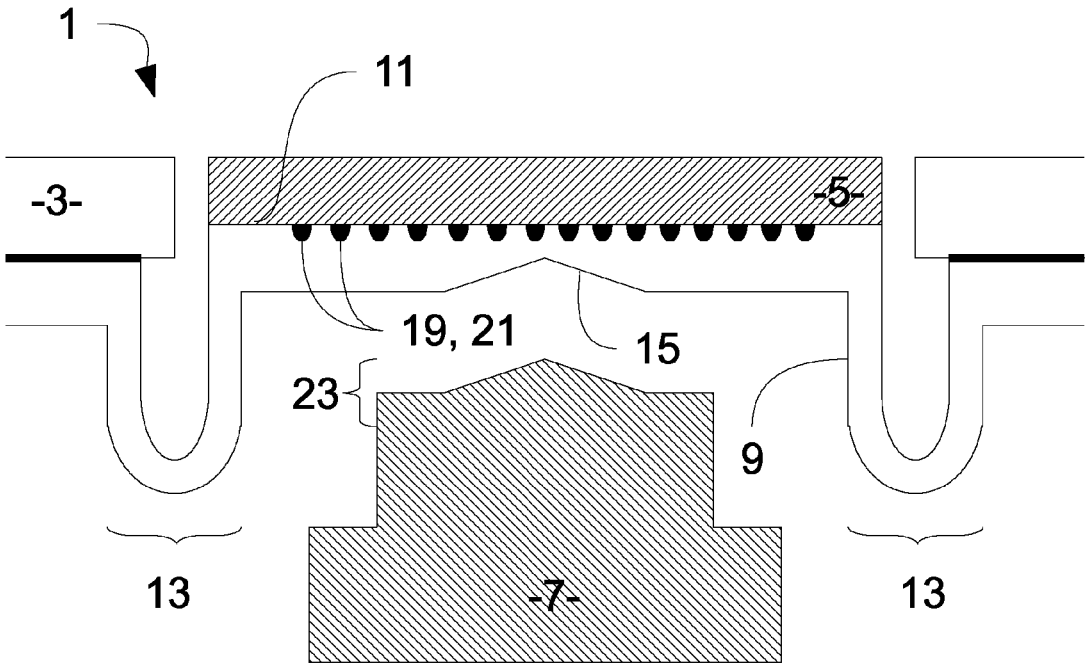
FIG. 3 is a schematic cross-section of a push type button according to a second embodiment of the invention.

FIG. 3 shows an alternative embodiment of a push type button 1 according to the invention.

In this embodiment, the narrowing 15 of the diaphragm 9 is in the form of a recess over the inner surface thereof, opposite the commutator 7. The commutator 7 then has an upper portion 23 which has a corresponding shape and dimensions and which engages in the recess when the movable portion 5 is brought into an actuation position.

The upper surface 11 of the diaphragm 9 is planar, with the exception of the grooves 21 for the adhesive 19. The surface of the movable portion 5 located opposite is also planar and particularly does not comprise any protuberances 17.

Figure 4:
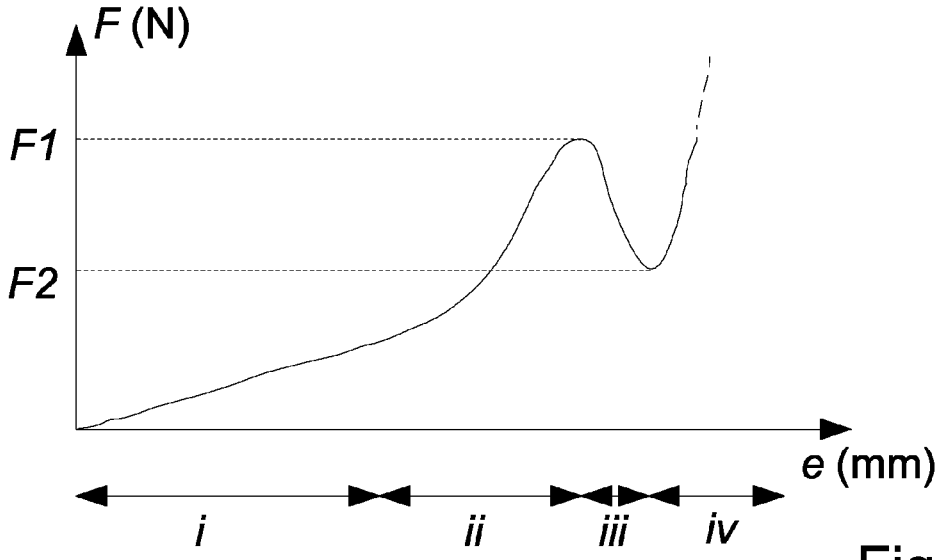
FIG. 4 is a simplified graph of the reaction force in accordance with the pressing-in during the actuation of a button according to the invention.

FIG. 4 is an approximate graph of the reaction force F of the push button 1 in accordance with the pressing-in action e which is applied to the movable portion 5.

The force F is given in Newtons (N) and the pressing-in e is given in millimeters (mm).

The development of the force F in accordance with the pressing-in e is divided into four segments which are designated i to iv.

In the first portion i, from a pressing-in e which is zero to a pressing-in value e where the diaphragm 9 moves into contact with the commutator 7, the force F develops in a linear manner in accordance with a first gradient.

During this portion i, the reaction originates substantially from the diaphragm 9 which is deformed resiliently and tends to return to a rest position with a force F which is proportional to the deformation which is here the pressing-in action e. The first gradient thus corresponds to the rigidity constant of the diaphragm 9.

In the second portion ii, the force F increases in a greater manner with an optionally variable gradient which increases and which is greater than in the first portion i.

During this portion ii, the reaction F originates from the diaphragm 9 and the commutator 7, which comprises a resilient element which stores the deformation energy until it reaches the tipping point, for example, a metal leaf spring or a snap element which carries contacts.

In the third portion iii, the force F decreases abruptly from a maximum local value F1 to a minimum local value F2.

During this period iii, the tipping point is reached at the start, the commutator pivots from a first state toward a second state, the resilient element giving up the energy necessary for the pivoting, which causes the reaction force decrease F observed.

In the fourth portion iv, the force F again increases powerfully with the pressing-in action e.

During this period iv, the commutator 7 has reached the limit of the resilient deformability thereof and the entire button is in fact in the course of being compressed as far as permanent deformation of the components thereof. That fourth portion is not passed through during normal use, and corresponds to the base stop of the button 1.

The snap effect of the buttons 1 according to the invention which is given as being (F1–F2/F1) is according to studies of prototypes, greater than 40%, in the order of 43% on average.

The haptic return perceived is thus far greater which improves the appreciation of the button 1 by the user and makes the use of the button 1 easier and more reliable, given that actuation which is not perceived, and therefore a double actuation because the first actuation is not perceived, is less probable particularly, for example, when the user is wearing gloves which reduce the haptic perception.

The invention claimed is:

1. A push button comprising:

a fixed portion which forms a frame;

a movable portion which can be moved in terms of translation between a rest position which is taken up in the absence of any actuation by a user and an actuation position which is taken up by pressing in the movable portion in relation to the fixed portion;

a commutator which pivots from a first state toward a second state when the movable portion is brought into the actuation position; and a flexible diaphragm which is arranged between the movable portion and the commutator, which is connected at the edges thereof to the fixed portion and which moves the movable portion into a rest position in the absence of any actuation by the user, wherein the flexible diaphragm comprises:

a narrowing of the thickness thereof opposite the commutator, an upper surface that carries the movable portion, and deformation zones between portions adhesively bonded to the fixed portion and the upper surface, the deformation zones being at the periphery of the diaphragm and having a U-like cross section.

2. The button as claimed in claim 1, wherein the narrowing comprises a recess at the outer surface of the diaphragm and the movable portion comprises a protuberance which has a complementary shape and which is inserted in the recess.

3. The button as claimed in claim 1, wherein the narrowing comprises a recess at the inner surface of the diaphragm and the commutator comprises an upper portion which has a complementary shape and which is inserted in the recess when the button is actuated.

4. The button as claimed in claim 2, wherein the recess has a progressively changing cross-section.

5. The button as claimed in claim 4, wherein the recess is conical.

6. The button as claimed in claim 4, wherein the recess is trapezoidal.

7. The button as claimed in claim 4, wherein the recess is stepped.

8. The button as claimed in claim 2, wherein the movable portion is adhesively bonded to the outer surface of the diaphragm.

9. The button as claimed in claim 8, wherein the recess and the protuberance have slightly different shapes so as to cause an accumulation of adhesive therebetween.

10. The button as claimed in claim 8, wherein the outer surface of the diaphragm comprises grooves for the adhesive which is intended to keep the movable portion adhesively bonded.

11. The button as claimed in claim 1, wherein the movable portion is welded to the outer surface of the diaphragm.

12. The button as claimed in claim 1, wherein the diaphragm is produced from an injection-molded thermoplastic elastomer material.

13. The button as claimed in claim 12, wherein the injection-molded thermoplastic elastomer material is one of the following: polyurethane elastomer material, polyethylene elastomer material, polyamide elastomer material.

14. A vehicle key module having an integrated transmitter for the remote control of locking/unlocking functions for the doors of a vehicle, the module comprising:

at least one push button, the push button comprising:

a fixed portion which forms a frame, a movable portion which can be moved in terms of translation between a rest position which is taken up in the absence of any actuation by a user and an actuation position which is taken up by pressing in the movable portion in relation to the fixed portion, a commutator which pivots from a first state toward a second state when the movable portion is brought into the actuation position, a flexible diaphragm which is arranged between the movable portion and the commutator, which is connected at the edges thereof to the fixed portion and which moves the movable portion into a rest position in the absence of any actuation by the user, wherein the flexible diaphragm comprises:

a narrowing of the thickness thereof opposite the commutator, an upper surface that carries the movable portion, and deformation zones between portions adhesively bonded to the fixed portion and the upper surface, the deformation zones being at the periphery of the diaphragm and having a U-like cross section.

* * * * *